US006155435A

United States Patent [19]

Malik

[11] Patent Number: 6,155,435

[45] Date of Patent: Dec. 5, 2000

[54] MEDIA STORAGE OR DISPLAY ASSEMBLY MODULAR MEDIA STORAGE UNITS AND MOVABLE SHELVES THEREFOR AND METHODS OF MAKING THE SAME

[76] Inventor: Vijay S. Malik, 4405 Fairmount Ave., Kansas City, Mo. 64111

[21] Appl. No.: 09/295,193

[22] Filed: Apr. 20, 1999

Related U.S. Application Data

[60] Provisional application No. 60/120,177, Feb. 16, 1999.

[51] Int. Cl.[7] ..... A47B 43/00; A47B 57/26

[52] U.S. Cl. ..... 211/41.12; 211/187; 211/194; 108/66; 108/91; 108/64

[58] Field of Search ..... 211/41.12, 40, 211/186–188, 194; D6/407; 206/509; 108/66

[56] References Cited

U.S. PATENT DOCUMENTS

| | | | |
|---|---|---|---|
| D. 365,243 | 12/1995 | Kwa | D6/629 |
| D. 365,244 | 12/1995 | Hawkins | D6/629 |
| 1,374,633 | 4/1921 | Boyle | 108/91 |
| 3,655,065 | 4/1972 | Yellin | 211/194 |
| 3,906,872 | 9/1975 | Erickson | 108/91 |
| 4,423,913 | 1/1984 | Lee | 211/194 |
| 4,567,989 | 2/1986 | Hurst, Jr. | 211/194 |
| 4,628,625 | 12/1986 | Hepp | 211/194 |
| 4,760,800 | 8/1988 | Hanson | 108/91 |
| 4,942,967 | 7/1990 | Schneider | 211/188 |
| 4,955,485 | 9/1990 | Alton | 211/188 |
| 4,961,506 | 10/1990 | Lang | 211/188 |
| 5,038,942 | 8/1991 | Wright | 211/194 |
| 5,148,928 | 9/1992 | Arnold | 211/187 |
| 5,167,331 | 12/1992 | Luukkonen | 211/187 |
| 5,218,914 | 6/1993 | Dickinson | 108/64 |
| 5,285,907 | 2/1994 | Franchere et al. | 211/194 |
| 5,310,071 | 5/1994 | Rivlin et al. | 206/509 |
| 5,370,245 | 12/1994 | Tersch et al. | 211/194 |
| 5,411,153 | 5/1995 | Unfried | 211/194 |
| 5,452,811 | 9/1995 | Taravella et al. | 211/188 |
| 5,487,599 | 1/1996 | Weisburn et al. | 312/9.46 |
| 5,577,620 | 11/1996 | Jacob | 211/40 |
| 5,584,391 | 12/1996 | Weisburn | 206/387.15 |
| 5,584,398 | 12/1996 | Lin | 211/188 |
| 5,588,541 | 12/1996 | Goetz | 211/194 |
| 5,595,312 | 1/1997 | Dardashti | 211/188 |
| 5,697,500 | 12/1997 | Walker | 206/509 |
| 5,699,925 | 12/1997 | Petruzzi | 206/509 |
| 5,724,894 | 3/1998 | Knorovsky | 108/91 |
| 5,730,300 | 3/1998 | Chen | 211/40 |
| 5,775,046 | 7/1998 | Fanger et al. | 108/64 |
| 5,809,905 | 9/1998 | John et al. | 108/64 |
| 5,964,163 | 10/1999 | Cohen | 211/188 |
| 5,979,677 | 11/1999 | Simpson, II et al. | 211/188 |

*Primary Examiner*—Daniel P. Stodola
*Assistant Examiner*—Jennifer E. Novosad
*Attorney, Agent, or Firm*—Richard L. Marsh

[57] ABSTRACT

A media storage or display assembly is adapted to stand erect and receive multiple media storage cartridges therein. The media storage assembly comprises at least one modular media storage unit having multiple upright members, multiple intermediate shelf units, a lower base and an upper base. Each multiple upright member is releasably secured in a receiving socket in the lower base and additionally releasably secured in a receiving socket in the upper base. The multiple intermediate shelf units are disposed intermediate the upper base and the lower base upon the multiple upright members. Each intermediate shelf unit has multiple keyhole shaped ports disposed therethrough adjacent an outer peripheral rim of the shelf unit, each port adapted for receiving one of the upright members therethrough and having a mechanism for slidably engaging the upright member associated therewith.

1 Claim, 6 Drawing Sheets

20
23
94
110
114
125
71
126
92
26
27
127
25
28
10
111
21
112
113
22
123
128
3
93
124
74
79
24
13
14
29
120
121
122

MEDIA STORAGE OR DISPLAY ASSEMBLY MODULAR MEDIA STORAGE UNITS AND MOVABLE SHELVES THEREFOR AND METHODS OF MAKING THE SAME

CROSS REFERENCE TO RELATED APPLICATION

This application is a non-provisional application under 35 U.S.C. 111 (a) of its parent provisional application Serial No. 60/120,177, filed Feb. 16, 1999.

BACKGROUND OF THE INVENTION

Field of the Invention

This invention relates to a media storage or display assembly adapted to stand erect and receive multiple media storage cartridges thereon, the media storage unit comprising at least one modular media storage unit therefor, the modular media storage unit comprising multiple upright members, multiple intermediate shelf units, a lower base and an upper base, wherein each multiple upright member is releasably secured in a receiving socket in the lower base and additionally releasably secured in a receiving socket in the upper base, the multiple intermediate shelf units being disposed between the bases and movable upon the multiple upright members.

SUMMARY OF THE INVENTION

Numerous media storage units of the prior art have fixed width slots for receiving media cartridges therein thereby limiting the efficiency of the storage unit. For instance, see the U.S. Design Pat. No. Des. 365,243 issued on Dec. 19, 1995 to Ping-Ling Kwa. These units are generally used only as singular free standing units and cannot be extended in any direction. Furthermore, many slots are let unfiled for one given type of cartridge whereas no slots are available for a different size cartridge. Accordingly, a modular media storage unit adapted to separately stand erect and receive multiple media storage cartridges thereon is needed.

It is known to provide a media storage unit comprising a support surface having a plurality of spaced parallel elongated ribs formed thereon providing elongated storage slots therebetween for receiving CD storage boxes therein, the support surface having a serrated area formed thereon adjacent the front end opening of said slots for engaging the storage boxes. The ribs and storage slots therebetween are arranged in four sets, each set generally extending at a right angle with respect to the adjacent set. For instance, see the U.S. Pat. No. 5,584,391 issued on Dec. 17, 1996 to James T. Weisburn or the U.S. Pat. No. 5,487,599 issued on Jan. 30, 1996 to Weisburn, et al. These units may be stacked to provide for additional vertical storage, however, a base, a top or set of support legs is left over for each additional increment of height and must be discarded. Also, the slots are substantially uniform and fixed in width to receive only CD storage boxes therein. Thus, there is a need for a modular media storage unit which can be adapted to receive any size media storage cartridge whilst using all components of each storage unit.

It is also known to provide an integral compact disk and audio cassette display kiosk having separate, different sized fixed openings for compact disks and video tapes. For instance, see the U.S. Design Pat. No. Des. 365,244 issued on Dec. 19, 1995 to Laura Hawlins. The kiosk is of fixed size and cannot be extended in any direction. Thus, there is a need for a modular media storage unit having able shelves which can be adapted to receive any size media storage cartridge and which may be extended horizontally and/or vertically.

Yet another known media storage device composes a base having a raised front portion and a top set at an oblique angle with a plurality of modular components stacked on top of the base, each modular component having legs formed at the periphery thereof for engaging an adjacent modular component and forming a storage slot. For instance, see the U.S. Pat. No. 5,577,620 issued on Nov. 26, 1996 to Gary Jacob. Though various media cartridges may be displayed on this device, each slot is adapted to receive only one type media cartridge. Therefore, there is a need for a media storage assembly comprising modular media storage units adapted to separately stand erect and receive multiple media storage cartridges thereon.

Still another known compact disk shelf assembly comprises a first and second bottom plates, first and second top plates, first and second left lateral plates, first and second right lateral plates and first and second longitudinal middle plates, wherein projecting rims of each of the lateral plates and each of the longitudinal middle plates are received in respective recesses in respective top and bottom plates. For instance, see the U.S. Pat. No. 5,730,300 to Shun-Teng Chen issued on Mar. 24, 1998. In order to make separate disk units the longitudinal middle plates must be discarded and replaced with either a left lateral plate or a right lateral plate. Therefore, it is an object of this invention to provide for individual modular media storage units which may be joined in vertical and/or horizontal fashion without discarding any parts.

Another media storage and display tower is known which has fixed shelves captured between the ends of support rods, the support rods being screwed together at each fixed shelf location. The tower may also have adjustable shelves between the fixed shelves, these adjustable shelves being held in place with separate spring-like clips. For instance see the U.S. Pat. No. 5,595,312 issued on Jan. 21, 1997 to Shahriar Dardashti. These units may be extended vertically, however, a base unit is left over for each additional increment of height and must be discarded. Thus, there is a need for a modular media storage and display assembly which may be extended vertically and/or horizontally into an integrated assembly which further has infinitely adjustable shelves, the shelves having integral locking mechanisms associated therewith and adapted to receive any size media storage cartridge thereon.

Therefore, it is an object of this invention to provide a media storage assembly adapted to stand erect and receive multiple media storage cartridges thereon, the media storage assembly comprising at least two modular media storage units adapted to separately stand erect and receive multiple media storage cartridges thereon, each modular media storage unit comprising multiple upright members, at least one intermediate shelf unit, a lower base and an upper base, wherein the media storage assembly is adapted to be extended vertically by placing one modular media storage unit on top of another modular media storage unit and affixing the lower base of the one modular media storage unit to the upper base of the another modular media storage unit.

It is another object of this invention to provide a modular media storage unit adapted to stand erect and receive multiple media storage cartridges thereon, the modular media storage unit comprising multiple upright members, multiple intermediate shelf units, a lower base and an upper base, wherein each multiple upright member is releasably secured in a receiving socket in the lower base and additionally releasably secured in a receiving socket in the upper base, the intermediate shelf units being disposed between the upper base and the lower base upon the multiple upright members.

It is another object of this invention to provide a modular media storage unit having intermediate shelf units wherein each intermediate shelf unit has multiple keyhole ports disposed through the thickness thereof from the bottom to the top, each keyhole port adapted for receiving one of the upright members therethrough.

It is yet another object of this invention to provide a modular media storage unit having intermediate shelf units wherein each intermediate shelf unit has means for slidably engaging the multiple upright members.

It is still another object of this invention to provide a modular media storage unit having multiple intermediate shelf units wherein each intermediate shelf unit has multiple keyhole ports disposed therethrough, each keyhole port having a major portion thereof which is substantially circular, although the major portion may alternately be triangular or elliptical or polygonal.

Still another object of this invention to provide a modular media storage unit having multiple intermediate shelf units wherein each intermediate shelf unit has multiple keyhole ports disposed therethrough wherein a major portion of the keyhole port is disposed adjacent an outer rim of the intermediate shelf unit.

An additional object of this invention to provide a modular media storage unit having multiple intermediate shelf units, each intermediate shelf unit having multiple keyhole ports disposed therethrough with a major portion of each keyhole port disposed adjacent an outer rim of the intermediate shelf unit, wherein the keyhole ports have a living hinge portion disposed opposite the major portion, the living hinge portion having a means for engaging and a means for locking disposed on the exposed terminal end thereof.

A further object of this invention is to provide a modular media storage unit having multiple intermediate shelf units, each intermediate shelf unit having multiple keyhole ports disposed therethrough with a major portion of the keyhole port disposed adjacent an outer rim of the intermediate shelf unit each keyhole port having a living hinge portion disposed opposite the major portion, the living hinge portion having a means for engaging adapted to force the upright member against the major portion.

Another significant object of this invention is to provide a modular media storage unit having multiple intermediate shelf units, each intermediate shelf unit having multiple keyhole ports disposed therethrough with a major portion of the keyhole port disposed adjacent an outer rim of the intermediate shelf unit, each keyhole port having a living hinge portion disposed opposite the major portion, the living hinge portion having the means for engaging wherein the means for engaging and the major portion frictionally engage the upright member and thereby releasably secure the intermediate shelf to the upright member.

Those skilled in the art will appreciate that another object of this invention is to provide a modular media storage unit having multiple intermediate shelf units wherein each intermediate shelf unit has depressed portions disposed into the upper surface thereof having raised ribs therebetween.

Still more significant objects of this invention include providing a modular media storage unit having multiple intermediate shelf units having depressed portions disposed into the upper surface thereof having raised ribs therebetween wherein the raised ribs and the depressed portions comprise slots adapted to receive the end or edge of a CD cartridge therein and wherein the slots may be disposed transversely, longitudinally or both.

A further object of this invention is to provide a modular media storage unit having multiple intermediate shelf units each intermediate shelf unit having depressed portions disposed into the upper surface thereof having raised ribs therebetween, the depressed portions comprising slots wherein the slots are approximately one half inch in width to loosely retain a media cartridge therein.

Skilled artisans will appreciate that another object of this invention is to provide a modular media storage unit having multiple intermediate shelf units wherein each intermediate shelf unit is substantially trapezoidal.

A further object of this invention is to provide a modular media storage unit comprising multiple upright members, multiple intermediate shelf units, a lower base and an upper base, the lower base and the upper base having receiving sockets therein wherein the receiving sockets in the upper base are formed into a bottom of the upper base opposite a boss protruding upwardly from an upper surface of the upper base.

A further object of this invention is to provide a modular media storage unit comprising multiple upright members, multiple intermediate shelf units, a lower base and an upper base, the lower base and the upper base having receiving sockets therein, the receiving sockets in the upper base being provided into a bottom of the upper base opposite a boss protruding upwardly from an upper surface of the upper base, wherein the boss protruding from the first surface is adapted to be received in a corresponding socket in a lower base of an additional unit.

Finally, it is an object of this invention is to provide a modular media storage unit comprising multiple upright members, multiple intermediate shelf units, a lower base and an upper base, the lower base and the upper base having receiving sockets therein, the receiving sockets in the upper base being provided into a bottom of the upper base opposite a boss protruding upwardly from an upper surface of the upper base, wherein the boss protruding from the first surface is adapted to be received in and frictionally engaged in a corresponding socket in a lower base of an additional unit.

DESCRIPTION OF THE PREFERRED EMBODIMENTS

While the various features of this invention are hereinafter described and illustrated as a media storage assembly adapted to stand erect and receive multiple media storage cartridges thereon, said media storage assembly comprising at least one modular media storage units, each said modular media storage unit comprising multiple upright members, multiple intermediate shelf units, a lower base and an upper base wherein each said multiple upright member is releasably secured in a receiving socket in said lower base and additionally releasably secured in a receiving socket in said upper base, said multiple intermediate shelf units being disposed intermediate said upper base and said lower base upon said multiple upright members, it is to be understood that the various features of this invention can be used singly or in various combinations thereof to provide other modular media storage units as can hereinafter be appreciated from a reading of the following description.

Figure 1:
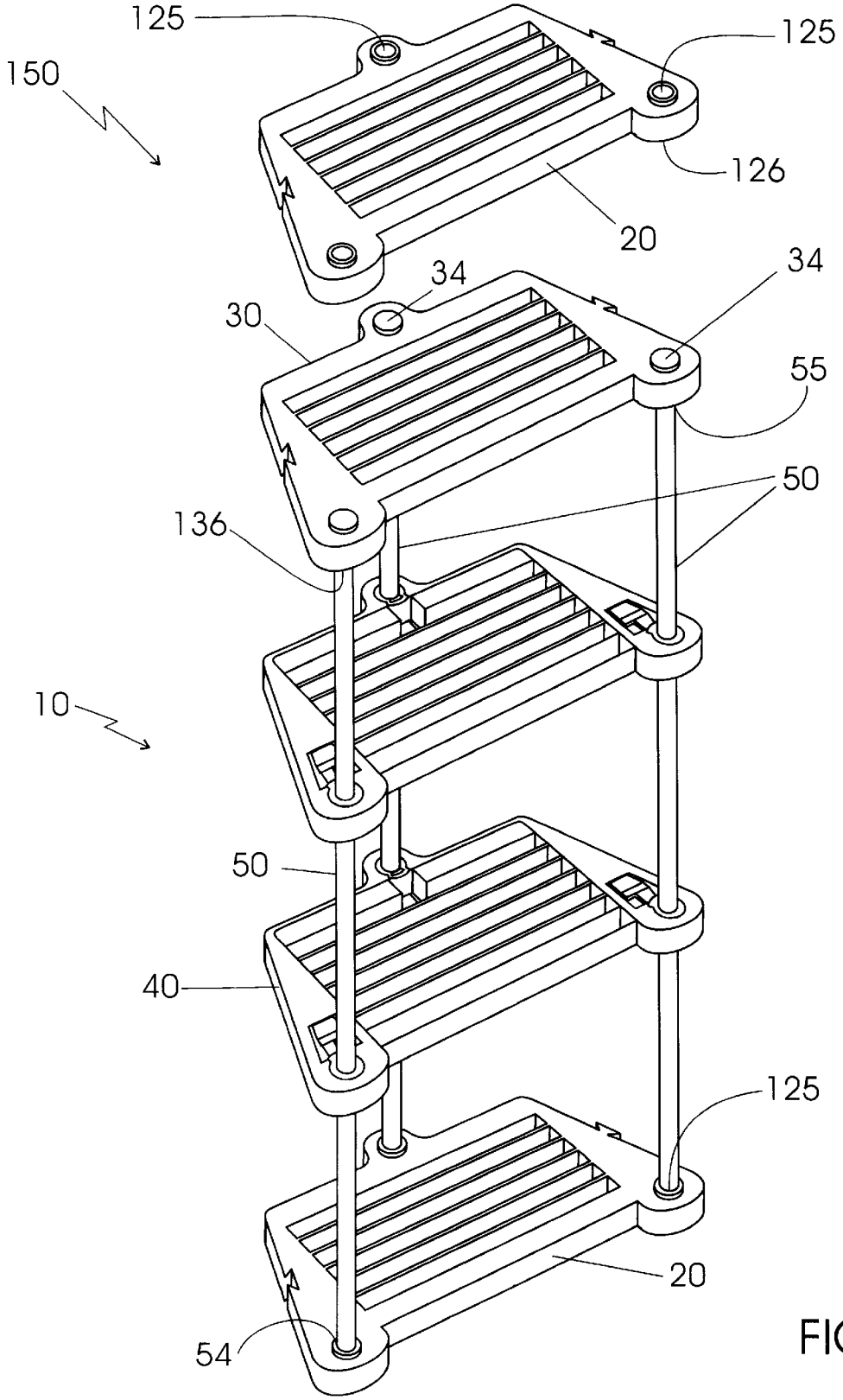
FIG. 1 is a perspective view of the preferred embodiment of the invention showing one upright modular media storage or display unit the base of another upright media storage or display unit disposed above the upper base of the first unit for engagement thereupon.

Referring now to FIG. 1, a media storage assembly 150 adapted to stand erect and receive multiple media storage cartridges thereon comprises at least one modular media storage unit generally shown by the reference numeral 10 which is adapted to separately stand erect and receive multiple media storage cartridges thereon, modular media storage unit 10 comprising multiple upright members 50, at least one intermediate shelf unit 40, a lower base 20 and an upper base 30. Each multiple upright member 50 has one end 54 releasably secured in a top receiving socket 125 in lower base 20 and the opposite end 55 additionally releasably secured in a bottom receiving socket 136 in upper base 30 with multiple intermediate shelf units 40 being disposed intermediate upper base 30 and lower base 20 upon multiple upright members 50. Intermediate shelf units 40 have multiple keyhole shaped ports 44 disposed therethrough each keyhole port 44 adapted for receiving upright members 50 therein during assembly of modular media storage unit 10. When erected as shown in FIG. 1, modular media storage unit 10 may be utilized to store various media cartridges upon lower base 20, any of intermediate shelf units 40 or upon upper base 30. Additionally, media storage or display assembly 150 may be extended vertically by placing a second modular media storage unit 10 on top of a first modular media storage unit 10 and affixng a lower base 20 of one modular media storage unit 10 to upper base 30 of another modular media storage unit 10 as will be hereinafter described. Furthermore, media storage or display assembly 150 may be extended upon a horizontal surface in distinct segments of a circle in a polygonal form by attaching additional modular media storage units 10 to the modular media storage unit 10 of FIG. 1 edgewise fashion as will be hereinafter described. In FIG. 1, in order to render the drawings readable, only the lower base 20 of a second modular media storage unit 10 is shown ready to be assembled to the upper base 30 of a first modular media storage unit 10 to provide for a first vertical extension. It should be within the realm of readers of this specification that constuction of a media storage or display assembly 150 may proceed to a height and/or degree of circularity desired by the user by extending media storage units 10 vertically and/or in edgewise fashion as described herein. It will hereinafter become readily apparent to those skilled in the art that modular media storage unit 10 may also be configured to provide storage for CD cartridges, digital video discs, audio tapes, computer discs, video tapes and the like.

Figures 2, 3, 10:
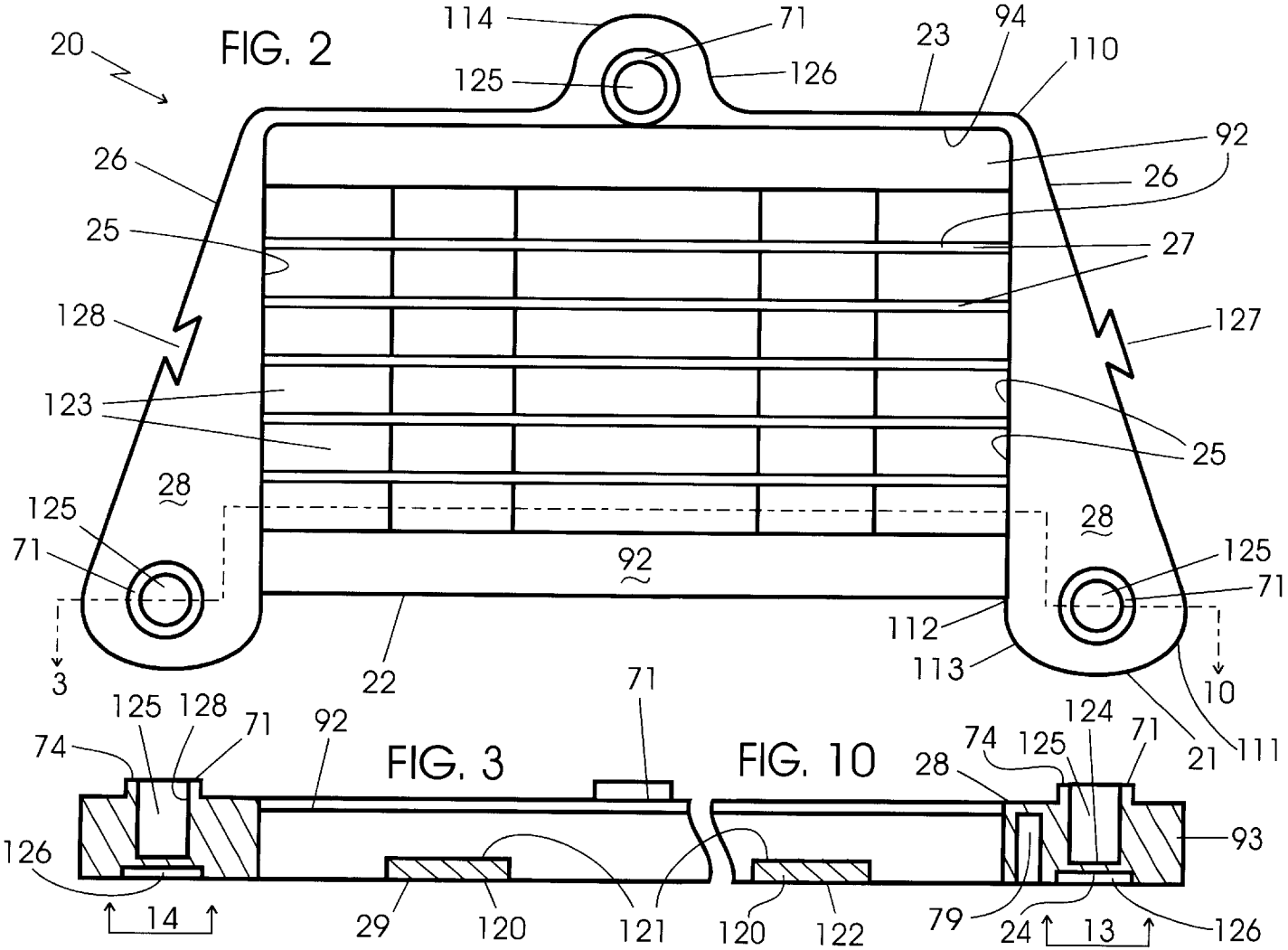
FIG. 2 is an top plan view of the preferred embodiment of the lower base of the modular media storage unit of FIG. 1 showing transverse slots and receiving sockets provided in the upper surface thereof.
FIG. 3 is a partial front view of a section taken along line 3-10 of the lower base of FIG. 2 showing one construction thereof.
FIG. 10 is a partial front view of a section of the preferred construction of the lower base of FIG. 2, taken along line 3-10.

In order to achieve a full understanding of the construction and function of each of the parts of modular media storage unit 10, each part will be described separately and then in relationship to the whole. Referring now to FIG. 2, lower base 20 is generally trapezoidal in shape having a front face 21, a rear face 23 and two angled side faces 26 joining front face 21 at junctures 110 and rear face 23 at junctures 111. Junctures 110, 111 are generally rounded thereby making a smooth transition from side faces 26 to front face 21 and rear face 23 respectively. Though not necessary for the function of modular media storage unit 10, front face 21 typically has a recessed face 22 provided therein, recessed face 22 providing an aesthetically pleasing look to modular media storage unit 10. When provided, recessed face 22 may have radiused corners 112 joining to rounded corners 113 of front face 21. A straight section may be provided between radiused corners 112 and rounded corners 113, these radiused corners 112, 113 being tangent to the straight section, or these radiused corners 112, 113 may be co-tangent. One angled face 26 has a projection associated therewith for being releasably secured in a mating slot in an opposite side face 26 of lower base 20 of another modular media storage unit 10. In the preferred embodiment shown in the figures, the projection, such as dovetail 127 is formed integrally with side edge 26 of lower base 20 and protrudes therefrom, dovetail 127 adapted to join with a mating slot such as dovetail slot 128 of an adjacent angled side face 26 of a lower base 20 of another modular media storage unit 10 when the user desires to extend modular media storage unit 10 upon a horizontal surface in distinct segments of a circle in a closed polygon fashion to form a larger media storage or display assembly 150. Likewise, the opposite angled face 26 has dovetail groove 128 disposed therein, dovetail groove 128 adapted to receive a dovetail 127 of an adjacent angled side face 26 of a lower base 20 of another modular media storage unit 10. Angled face 26 may be provided at any angle relative to front face 21 and rear face 23 but in this preferred embodiment, an angle of 18 degrees from the normal is used for each angled side face 26 such that the included angle between angled side faces 26 is 36 degrees. Thus, media storage assembly 150 is adapted to be extended upon a horizontal surface in distinct segments of a circle by attaching one modular media storage unit 10 to another modular media storage unit 10 in edgewise fashion edgewise fashion. Specifically, when ten lower bases 20 often modular media storage units 10 are assembled utilizing a projection such as dovetail 127 of each lower base 20 joined into a slot such as dovetail groove 128 of each successive lower base 20, a 360 degree full circle of lower bases 20 may be erected for forming one configuration of media storage or display assembly 150. The 360 degree full circle often modular media storage units 10 may be completed by assembling the requisite number of upright members to the ten lower bases with the desired number of intermediate shelves thereon and ten upper bases 30, shown in FIG. 4, of the ten modular media storage units 10 are assembled utilizing a projection such as dovetail 137 of each upper base 30 joined into a slot such as dovetail groove 134 of each successive lower base 30. Of course, any lesser number of lower bases 20 may be joined in edgewise fashion upon a horizontal surface in distinct segments of a circle for another configuration of media storage or display unit 150 of less than a complete 360 degree full circle. For instance, two modular media storage units 10, may be interlocked at each upper base 30 by dovetail 137 and dovetail groove 134 and additionally at each lower base by dovetail 127 interlocked with dovetail grooves 128. Dovetail 127 and dovetail groove 128 may be as shown in FIG. 2 or may be any other tongue and groove joint providing the positive connection of dovetail 127 and dovetail groove 128. Furthermore, more than one dovetail 127 and dovetail groove 128 may be provided on each respective angled side face 26 or alternately one each of dovetail 127 and dovetail groove 128 may be provided on each angled side face 26, dovetail grooves 128 and dovetails 127 alternating to provide for assembly in distinct segments of a circle. In the preferred embodiment shown in FIG. 2, one dovetail 127 is centrally located between front face 21 and rear face 23 on angled side face 26 and one dovetail groove 128 is centrally located between front face 21 and rear face 23 on the opposite angled side face 26 though these dovetails 127 and dovetail grooves 128 may be at any other location along the respective side faces 26 as long as dovetails 127 and dovetail grooves 128 provide for extending modular media storage units 10 in edgewise fashion upon a horizontal surface in distinct segments of a regular circle.

Figures 4, 5, 11:
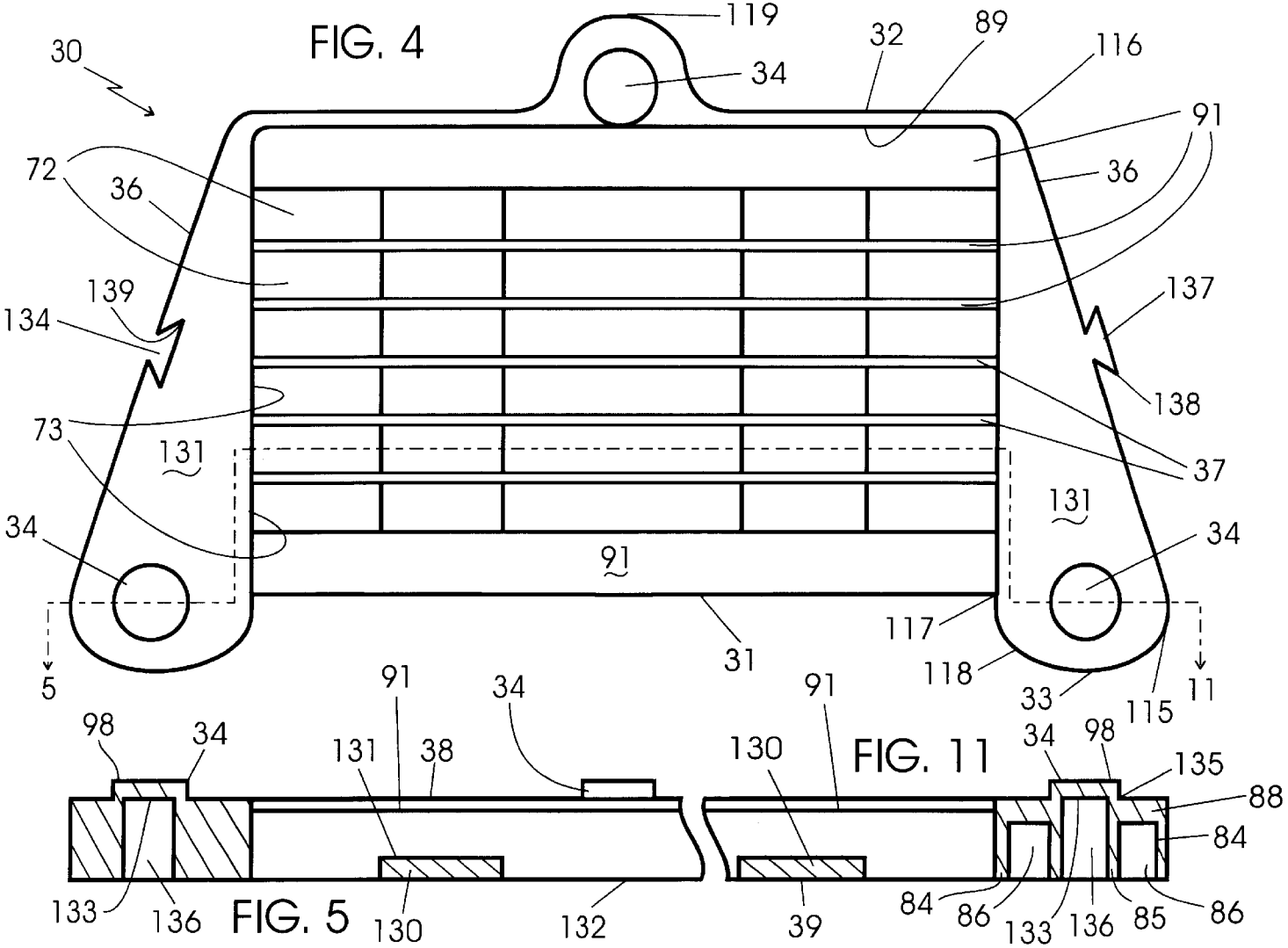
FIG. 4 is a top plan view of the preferred embodiment of the upper base of the modular media storage unit of FIG. 1 showing projecting bosses provided on the upper surface thereof.
FIG. 5 is partial front view of a section taken along line 5-11 of the upper base of FIG. 4 showing one construction thereof.
FIG. 11 is a partial front view of a section of the preferred construction of the upper base of FIG. 4, taken along line 5-11.

Referring now to FIGS. 2, 3 and 10, spaced substantially equally inwardly from angled side faces 26 and front face 21, and in a projecting boss 114 centrally located on rear face 23, are top receiving sockets 125 provided through boss tops 74 in bosses 71 on a top 28 of lower base 20 for receiving an upright member 50 therein at assembly of modular media storage unit 10. Aligned on a common axis with top receiving sockets 125 are bottom receiving sockets 126 provided in a bottom 29 of lower base 20. Each of receiving sockets 125 is separated from each of receiving sockets 126 by an internal socket wall 24 thus providing for a resting surface 124 for upright members 50 when assembled into receiving sockets 125. Socket wall 24 may best be observed in FIG. 3 or FIG. 10 between receiving sockets 125 and 126. Sockets 125, 126 provided in the opposite sides of boss 114 are identical in construction to the sockets 125, 126 shown in FIGS. 3 and 10. It is to be understood here, that the cross section shown in FIG. 3 is representative of solid construction of lower base 20 while the cross section shown in FIG. 10 is representive of the shell construction of the preferred embodiment. Referring now to FIG. 4, upper base 30 of modular media storage units 10 has at least one mating boss 34 associated therewith, mating boss 34 generally formed integrally with an upper surface 38 of upper base 30, for being releasably secured in lower receiving sockets 126 of a lower base 20 of another modular media storage unit 10 when placed thereupon. Receiving socket 126 has a depth at least equal to the height of a protruding mating boss 34 of upper base 30, mating boss 34 associated therewith for being releasably secured m lower receiving sockets 126, these elements cooperating to provide for vertical extension of modular media storage unit 10. Referring again to FIG. 2, though shown in this preferred embodiment as being disposed in projecting boss 114, receiving sockets 125 and 126 therein may alternately be disposed within the confines of lower base 20 inwardly from rear face 23, thus obviating the need for projecting boss 114.

Lower base 20 has solid wall portions 120 having a floor surface 122 substantially contiguous with bottom 29 and an resting surface 121 opposite floor surface 122 in a central portion of lower base 20, floor surface 122 adapted to rest flat upon a substrate such as a desktop or table top or the floor of a home or office. Resting surface 121 of solid wall 120 forms the base for cartridge receiving slots 123 provided into lower base 20 through a cartridge receiving plane 92 below top 28. Cartridge receiving slots 123 are depressed portions disposed through cartridge receiving plane 92, said depressed portions having ribs 27 therebetween, cartridge receiving slots 123 adapted to receive media cartridges therein. Cartridge receiving slots 123 are bounded by ribs 27 and ends 25 and are adapted to receive the end or edge of a CD cartridge, computer disc, audio tapes or digital video disc therein, these items adapted to rest upon resting surface 121. In FIGS. 2, 3 and 10, cartridge receiving slots 123 are disposed transversely of lower base 20 and are centrally located between angled faces 26. Cartridge receiving slots 123 are spaced from recessed face 22 and rear face 23 and are generally disposed centrally therebetween, the width of cartridge receiving slots 123 being slightly greater than the thickness of a CD cartridge, that is, approximately one-half inch in width, such that the media stored therein may readily be perused in a flip forward format, the depth of cartridge receiving slots 123 being great enough to prevent accidentally dislodging of the media therefrom.

Referring again to FIGS. 2, 3 and 10, the tops of ribs 27 and recessed face 22 are disposed below top 28 a short distance establishing a cartridge receiving plane 92 and a rear cartridge stop 94 spaced inwardly from rear face 23. Rear cartridge stop 94 is provided for longitudinal storage of media on the tops of ribs 27 such that legends on the ends of media cartridges may be readily perused. For instance, video cassette cartridges may be stored on the long side thereof longitudinally from recessed face 22 to rear stop 94 by abutting an end of the video cassette cartridge against rear stop 94. Of course, other media cartridges may be similarly placed upon tops of ribs 27. Generally, the user would store most media items longitudinally on lower base 20 and intermediate shelves 40 reserving the tops of the ribs 37 of upper base 30 for transverse storage in slots 72, thus providing for the aforementioned flip forward perusal at a reasonable height.

Though lower base 20, each intermediate shelf unit 40 and upper base 30 are usually utilized with upright members 50 to erect a modular media storage unit 10, each of these horizontally disposed portions 20, 30, 40 may be used as a single storage base for approximately six CD cartridges, thirty six computer discs, twelve audio tapes or six digital video discs or a combination of a reduced number of each thereof. It is readily apparent that each of these portions 20, 30, 40, when assembled with upright members 50 into a modular media storage unit, will accommodate the items listed immediately above.

Figure 13:
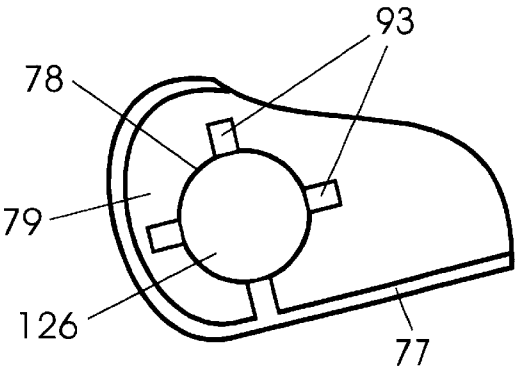
FIG. 13 is a partial broken away view of the under side of the lower shelf shown in FIG. 10 showing a lower receiving socket and webs surrounding an upper receiving socket.
Figure 14:
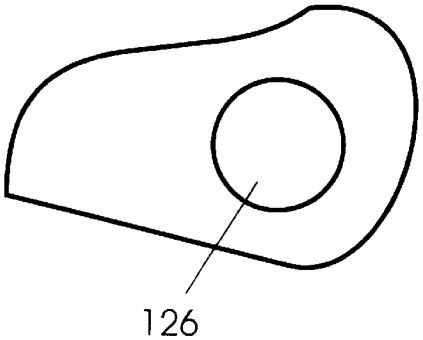
FIG. 14 is a partial broken away view of the under side of the lower shelf shown in FIG. 3 showing a lower receiving socket formed into a bottom surface of the lower shelf.
Figure 15:
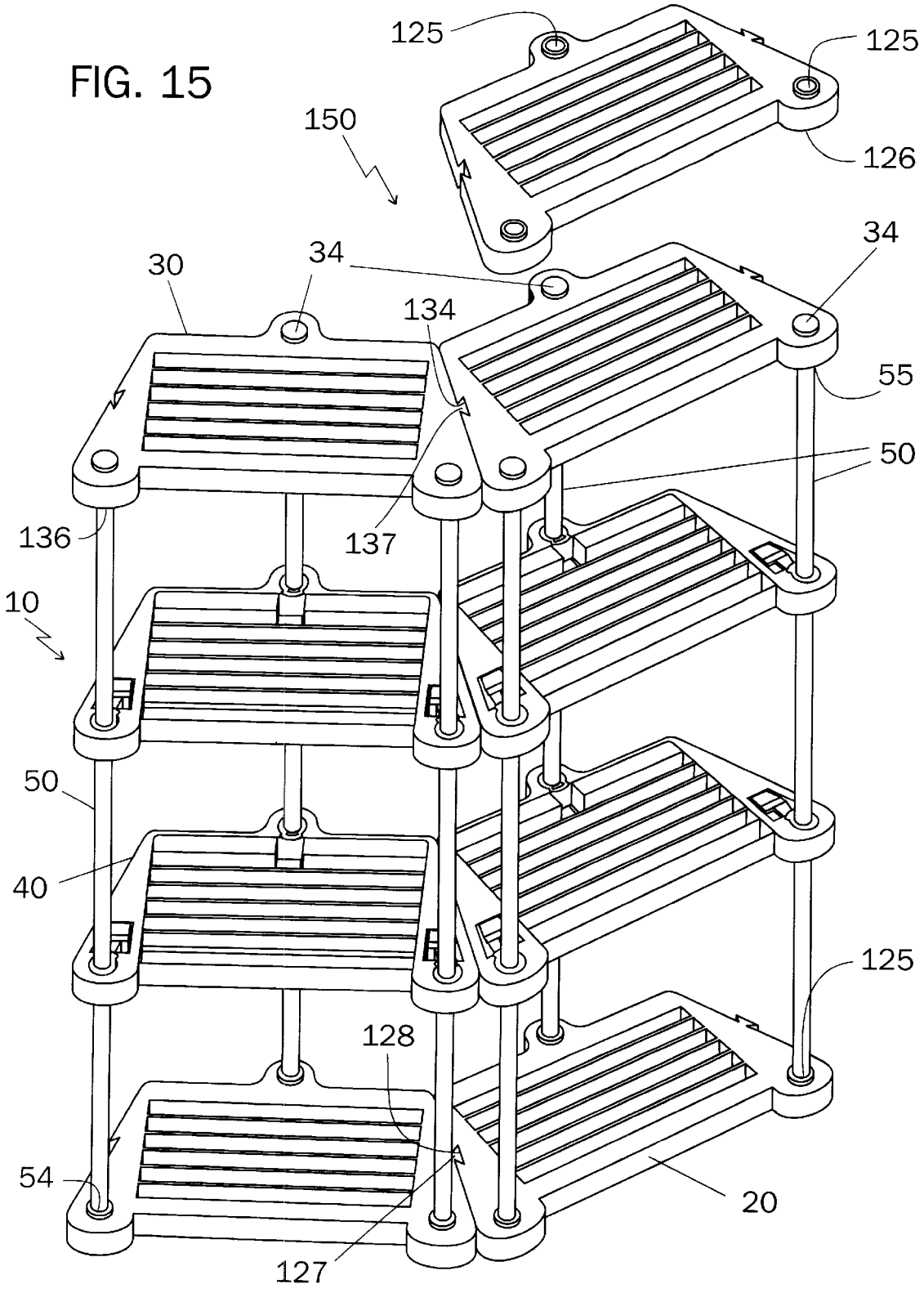
FIG. 15 is a perspective view of modular units joined in edgewise fashion at the upper shelves thereof and the lower bases thereof.

Lower base 20 may be substantially solid as shown in FIGS. 3 and 14 having receiving sockets 126 provided through bottom 29 to a depth at least the height of boss 74 while upper receiving sockets 125 are disposed through top 28 terminating at resting surface 124 and thus, socket 126 is a circular recess into bottom 29 as shown. Preferably, as shown in FIGS. 10 and 13, lower base 20 is constructed in shell format having a peripheral rim wall 77 extending completely around the outer periphery of angled side faces 26, rear face 23, projecting boss 114, front face 21, recessed face 22 and the ends 25 of cartridge receiving slots 123 of lower base 20 defining a cavity 79 therebetween. Annular wall 78 separates receiving sockets 125 from cavity 79, annular wall 78 having webs 93 formed integrally therewith extending into cavity 79 to provide support to annular wall 78. Thus, receiving sockets 125, 126 are provided in free standing tubular elements integrally formed with and depending from top 28, socket wall 24 separating receiving sockets 125 from receiving sockets 126. Peripheral rim wall 77 and annular wall 78 are approximately the same thickness as wall 120 and wall 24 though these thickness are discretionary. Referring especially to FIG. 13, webs 93 extend the entire length of annular wall 78 from boss top 74 to bottom 29 with sockets 126 disposed therein, bottom 29 also defining the lowermost portion of peripheral rim wall 77. Cavity 79 is provided in lower base 20 primarily to provide for material savings in the manufacture of lower base 20 thus also resulting in a savings of weight and cost.

Referring now to FIG. 4, upper base 30 is also generally trapezoidal in shape having a front face 33, a rear face 32 and two angled side faces 36 joining front face 33 at junctures 115 and rear face 32 at junctures 116. Junctures 115, 116 are generally rounded thereby making a smooth transition from side faces 36 to front face 33 and rear face 32 respectively. Though not necessary for the function of modular media storage unit 10, front face 33 typically has a recessed face 31 provided therein, recessed face 31 providing an aesthetically pleasing look to modular media storage unit 10. When provided, recessed face 31 has radiused corners 117 joining to rounded corners 118 of front face 33. A straight section may be provided between radiused corners 117 and rounded corners 118, these corners 117, 118 being tangent to the straight section, or these corners 117, 118 may be co-tangent. One angled face 36 has a projection associated therewith, such as a dovetail 137 protruding therefrom, dovetail 137 adapted to be releasably secured in a mating slot, such as a dovetail groove 134, in an opposite side face 36 of upper base 30 of another modular media storage unit 10, dovetail 137 adapted to join with dovetail groove 134 of an adjacent angled side face 36 of an upper base 30 of another modular media storage unit 10 when the user desires to extend modular media storage unit 10 horizontally. Other angled side face 36 has a dovetail groove 134 formed therein, dovetail groove 134 adapted to join with a dovetail 137 of another adjacent angled side face 36 of an upper base 30 of another modular media storage unit 10 when so erected. Dovetail 137 has ears 138 protruding from the central portion thereof adapted to releasably slide into ear slots 139 in dovetail groove 134. Ears 138 and ear slots 139 are substantially the same shape and size such that ears 138 are fictionally engaged within ear slots 139. Angled side face 36 may be provided at any angle relative to front face 33 and rear face 32 but in this preferred embodiment, an angle of 18 degrees to the normal is used such that an included angle of 36 degrees exists between angled side faces 36. Thus, when ten upper bases 30 of ten modular media storage units 10 are assembled utilizing dovetail 137 of each upper base 30 joined into dovetail groove 134 of each successive upper base 30, a 360 degree full circle of modular media storage units 10 may be erected forming one configuration of media storage or display assembly 150. Of course, any lesser number of upper bases 30 may be joined in edgewise fashion upon a horizontal surface in distinct segments of a circle for another configuration of media storage or display unit 150 of less than a complete 360 degree full circle. As with lower base 20, dovetail 137 and dovetail groove 134 in upper base 30 may be as shown in FIG. 4 or may be any other tongue and groove joint providing the positive connection of dovetail 137 and dovetail groove 134. Furthermore, more than one dovetail 137 and dovetail groove 134 may be provided on the respective angled side face 36 or alternately one each of dovetail 137 and dovetail groove 134 may be provided on each angled side face 36, dovetail grooves 134 and dovetails 137 alternating to provide for assembly of modular media storage units 10 into a circle. In the preferred embodiment shown in FIG. 4, one dovetail 137 is centrally located between front face 33 and rear face 32 on angled side face 36 and one dovetail groove 134 is centrally located between front face 33 and rear face 32 on the opposite angled side face 36 though these dovetails 137 and dovetail grooves 134 may be at any other location along the respective side faces 36 as long as dovetails 137 and dovetail grooves 134 provide for extending modular media storage units 10 in edgewise fashion upon a horizontal surface in distinct segments of a regular circle.

Referring now to FIGS. 4, 5 and 11, spaced substantially equally inwardly from angled side faces 36 and front face 33 and on projecting boss 119 centrally located on rear face 32 are protruding bosses 34 extending above a top 38 of upper base 30, bosses 34 adapted to be received in corresponding bottom receiving socket 126 of lower base 20 of another modular media storage unit 10 placed thereupon when the user desires to extend modular media storage unit 10 vertically. Mating boss 34 is separated from a receiving socket 136 formed into bottom 39 by a step 135 in a top wall 88 at top 38 of upper base 30, step 135 and top wall 88 establishing a stop 133 for opposite end 55 of upright members 50 when assembled into receiving sockets 136. Top 38 of upper base 30 is substantially flat except for protruding bosses 34 and is thus adapted to be readily mated to floor surface 122 of another modular media storage unit 10 stacked thereupon. Bosses 34 are aligned on common axes with receiving sockets 136, bosses 34 located in projecting boss 119 and spaced from angled side faces 36 and front face 33 the same distance as upper and lower receiving sockets 125, 126 in projecting boss 114 and spaced from these respective edges in lower base 20.

Top wall 88, protruding mating boss 34 and receiving socket 136 may best be observed in the section view shown in FIGS. 5 and 11, receiving socket 136 being provided into bottom 39 spaced inwardly from front face 33 and angled side faces 36 opposite a mating boss 34 protruding upwardly from an top 38 of upper base 30 wherein mating boss 34 and receiving socket 136 are aligned on a common axis. Bosses 34 on upper base 30 are substantially the same diameter and same height as bottom receiving sockets 126 in lower base 20 and are frictionally engaged in these corresponding bottom receiving sockets 126 when placed therein during assembly of one modular media storage unit 10 on top of a lower modular media storage unit 10. Though shown in this preferred embodiment as being disposed in rounded projecting boss 119, receiving socket 136 therein and mating boss 34 thereon may alternately be disposed within the confines of upper base 30 inwardly from rear face 32, thus obviating the need for projecting boss 119. As can be readily appreciated, upper base 30 and lower base 20 are substantially the same size and shape having the many common features described hereinbefore in order that modular media storage units 10 may be readily assembled together to form the media storage or display unit 150 for media cartridges.

It is to be understood here, that the cross section shown in FIG. 5 is representative of solid construction of upper base 20 while the cross section shown in FIG. 11 is representative of the shell construction of the preferred embodiment. In FIG. 5, upper base 30 has receiving sockets 136 provided through bottom 39 terminating at stop 133 and further has solid bosses 34 provided on top 38, though preferably, as shown in FIG. 11, upper base 30 is constructed in shell format having a peripheral rim wall 84 extending completely around the outer periphery of angled side faces 36, rear face 32, projecting boss 119, front face 33, recessed face 31 and recess 35 defining a cavity 86 therebetween. Mating boss 34 has a height at least equal to the depth of receiving socket 126 of lower base 20, mating boss 34 and socket 126 cooperating to provide for vertical extension of modular media storage unit 10. Cavity 86 is provided in upper base 30 primarily to provide for material savings in the manufacture of upper base 30 thus also resulting in a savings of weight and cost. In the preferred embodiment, receiving sockets 136 have an annular wall 85 provided therearound which separates receiving sockets 136 from cavity 86. Thus, receiving sockets 136 are provided in free standing tubular elements integrally formed with and depending from top wall 88, while bosses 34 extend upwardly from top wall 88 terminating in closed top surface 98. Peripheral rim wall 84 and annular wall 85 are approximately the same thickness as top wall 88, approximately one-eighth inch, though these thickness are discretionary.

Upper base 30 has solid wall portions 130 with a base surface 132 substantially planar with bottom 39. Opposite base surface 132 in a central portion of upper base 30, is a resting surface 131. Resting surface 131 of solid wall portions 130 forms the base for slots 72 provided into upper base 30 through top 38. Slots 72 are depressed portions disposed through top 38, these depressed portions having ribs 37 therebetween. Slots 72 are bounded by ribs 37 and ends 73 and are adapted to receive the end or edge of a CD cartridge, computer disc, audio tapes or digital video disc therein, these items to rest upon resting surface 131. In FIG. 4, slots 72 are disposed transversely of upper base 30 centrally located between angled faces 36 and are spaced from recessed face 31 and rear face 32 generally centrally therebetween, the width of slots 72 being slightly greater than the thickness of a CD cartridge, that is, approximately one-half inch in width, such that the media stored therein may readily be perused in a flip forward format, the depth of slots 72 being great enough to prevent accidentally dislodging of the media therefrom. For instance, cartridge receiving slot 72 is adapted to receive a side edge of a compact disc cartridge therein, the compact disc cartridge being loosely received in cartridge receiving slot 72 to enable the user to quickly peruse compact disc cartridges stored therein.

Referring again to FIGS. 4, 5 and 11, upper base 30 of modular media storage unit 10 has a cartridge stop 89 associated with rear face 32 for receiving media cartridges stored longitudinally thereon abutting cartridge stop 89. The tops of ribs 37 and recessed face 31 are disposed below top 38 a short distance establishing a cartridge receiving plane 91 and a rear cartridge stop 89 spaced inwardly from rear face 32. Cartridge receiving slots 72 are depressed portions disposed through cartridge receiving plane 91, these depressed portions having ribs 37 therebetween, cartridge receiving slots 72 adapted to receive media cartridges therein. Rear cartridge stop 89 is provided for longitudinal storage of media on the tops of ribs 37 such that legends on the ends of media cartridges may be readily perused. For instance, video cassette cartridges may be stored on the long side thereof longitudinally from recessed face 31 to rear cartridge stop 89 by abutting an end of the video cassette cartridge against rear cartridge stop 89. Of course, other media cartridges may be similarly placed upon receiving plane 91 on tops of ribs 37. Since the overall height of one modular media storage unit 10 is approximately two feet, the user can readily use slots 72 for transverse storage of the most often used media items for the aforementioned flip forward perusal in upper base 30 while using intermediate shelf units 40 and lower base 20 for longitudinally storage of lesser used media items. Since one modular media storage unit 10 is approximately two feet in height, an additional modular media storage unit 10 affixed to upper base 30 of the first modular media storage unit 10 would provide for the upper base of the additional media storage unit 10 at a height of approximately four feet, a reasonable height for viewing of media stored either transversely therein or longitudinally thereon.

Figure 6:
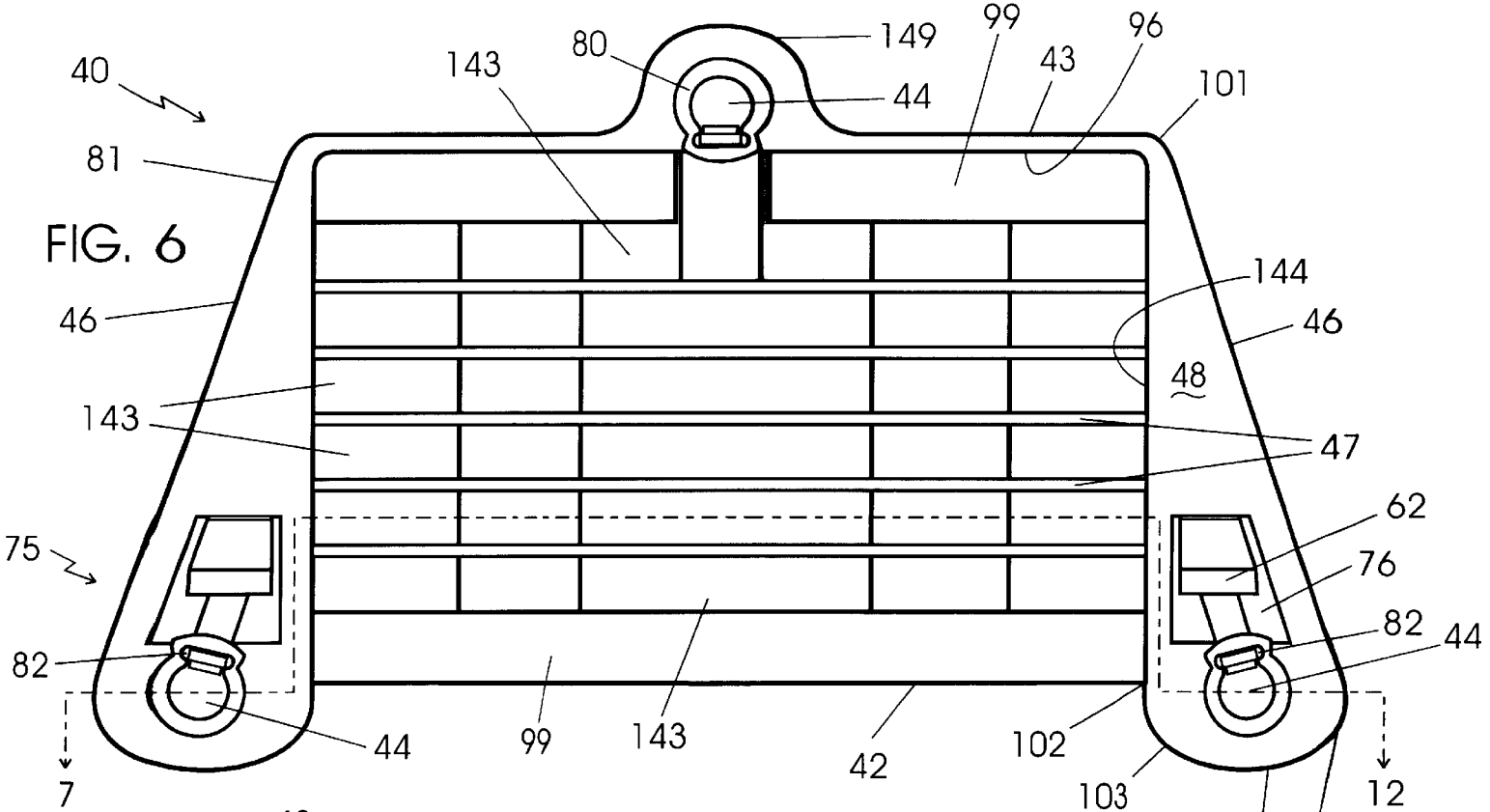
FIG. 6 is a top plan view of the preferred embodiment of the intermediate shelf units of the modular media storage unit of FIG. 1 showing transverse slots provided in the upper surface thereof, multiple keyhole ports disposed therethrough and living hinge portions associated with each multiple keyhole port.
Figure 7:
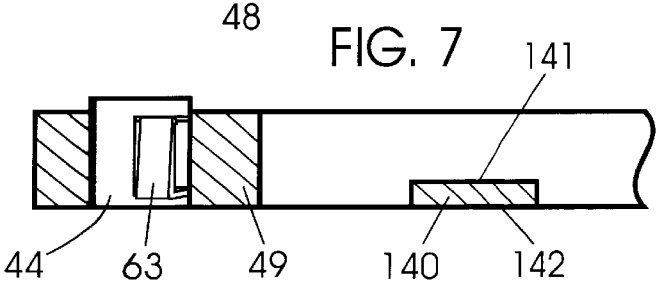
FIG. 7 is a partial front view of a section taken along line 7-12 of intermediate shelf unit of FIG. 6 showing one construction thereof.
Figure 12:
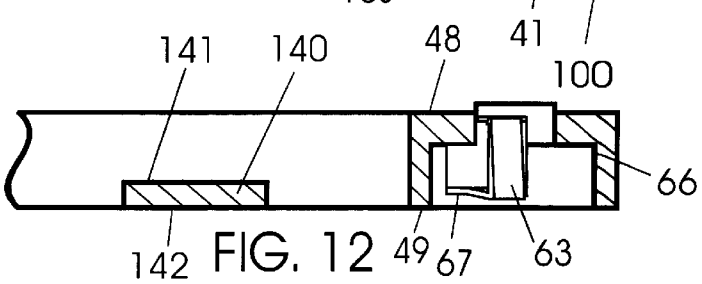
FIG. 12 is a partial front view of a section of the preferred construction of the intermediate shelf unit of FIG. 6, taken along line 7-12.

Referring now to FIGS. 6, 7 and 12, intermediate shelf units 40 are generally trapezoidal in shape having a front face 41, a rear face 43 and two angled side faces 46 joining front face 41 at junctures 100 and rear face 43 at junctures 101. Junctures 100, 101 are generally rounded thereby making a smooth transition from angled side faces 46 to front face 41 and rear face 43 respectively. Though not necessary for the function of modular media storage unit 10, front face 41 typically has a recessed face 42 provided therein, recessed face 42 providing an aesthetically pleasing look to modular media storage unit 10. When provided, recessed face 42 has radiused corners 102 joining to rounded corners 103 of front face 41. A straight section may be provided between radiused corners 102 and rounded corners 103, corners 102, 103 being tangent thereto or these corners 102, 103 may be cotangent. Though intermediate shelf units 40 are the same shape as upper base 30 and lower base 20, intermediate shelf units 40 are typically slightly smaller in length between angled side faces 46. Furthermore, as it is usually not desired to join angled side faces 46 of one intermediate shelf unit 40 to another intermediate shelf unit 40 when modular media storage units 10 are assembled side by side, angled side faces 46 have no means for joining together. Therefore, intermediate shelf units 40 may be readily moved upon upright members 50 from one position to another without disassembling any part of any modular media storage unit 10 of a media storage assembly 150. In order to move intermediate shelf units 40 upon upright members 50, a means for releasably retaining 75 is associated with each intermediate shelf unit 40, means for releasably retaining 75 adapted to engage at least one upright member 50 as will be hereinafter described.

Each intermediate shelf unit 40 has wall portions 140 having a lower surface 142 contiguous with a bottom 49 and a resting surface 141 opposite lower surface 142, wall portions 140 forming the base for slots 143 provided into intermediate shelf unit 40 through top 48. Each intermediate shelf unit 40 has a cartridge stop 96 associated with rear face 43 for receiving media cartridges stored longitudinally thereon abutting cartridge stop 96. The tops of ribs 47 and recessed face 42 are disposed below top 48 a short distance establishing a cartridge receiving plane 99 and a rear cartridge stop 96 spaced inwardly from rear face 43. Cartridge receiving slots 143 are depressed portions disposed through cartridge receiving plane 99, these depressed portions having ribs 47 therebetween, cartridge receiving slots 143 adapted to receive media cartridges therein. Cartridge receiving slots 143 are bounded by ribs 47 and ends 144 and are adapted to receive the end or edge of a CD cartridge, computer disc, audio tapes or digital video disc therein, these items adapted to rest upon resting surface 141 of wall portions 140. In FIGS. 6, 7 and 12, cartridge receiving slots 143 are disposed transversely of intermediate shelf unit 40 and are centrally located between angled side faces 46. Cartridge receiving slots 143 are spaced from recessed face 42 and rear face 43 and are generally also disposed centrally therebetween, the width of cartridge receiving slots 143 being greater than the thickness of a CD cartridge, approximately one half inch, such that these media items stored therein may readily be perused in a flip forward format, the depth of cartridge receiving slots 143 being great enough to prevent accidentally dislodging the media items therefrom. Though cartridge receiving slots 143 are shown disposed transversely of intermediate shelf unit 40, media may be disposed longitudinally from recessed face 42 to rear face 43 along the depth thereof with the legends thereon facing outwardly from recessed face 42. Cartridge receiving slots 143 are typically approximately one-half inch in width while ribs 47 are typically one-eighth inch in thickness. Rear cartridge stop 96 is provided for longitudinal storage of media on the tops 99 of ribs 47 such that legends on the ends of media cartridges may be readily perused. For instance, video cassette cartridges may be stored on the long side thereof longitudinally from recessed face 42 to rear cartridge stop 96 by abutting an end of the video cassette cartridge against rear cartridge stop 96. Of course, other media cartridges may be similarly placed upon tops 99 of ribs 47. Though intermediate shelf units 40 are usually utilized between lower base 20 and upper base 30 in an erect modular media storage unit 10, individual intermediate shelf units 40 may be placed upon a flat substrate and used as single storage base units for approximately six CD cartridges or thirty six computer discs, twelve audio tapes, or six digital video discs stored in cartridge receiving slots 143 or six video cartridges stored longitudinally upon top 48.

Still referring to FIGS. 6, 7 and 12, intermediate shelf units 40 have multiple keyhole shaped ports 44 disposed therethrough each keyhole port 44 adapted for receiving upright members 50 therein during assembly of modular media storage unit 10. Keyhole ports 44 are spaced the same distance apart as receiving sockets 125 and 136 in lower base 20 and upper base 30 respectively. Keyhole ports 44 are disposed through at least a portion of the thickness of intermediate shelf units 40 as shown in FIG. 12 and may extend through the entire thickness from bottom 49 to top 48 as shown in FIG. 7. A protruding portion thereof may extend above top 48.

Observing the section view of FIG. 7, intermediate shelf unit 40 may be of solid construction having keyhole ports 44 disposed completely through from bottom 49 and extending above top 48, however, in the preferred embodiment of this invention as shown in FIG. 12, keyhole ports 44 are formed integral with top 48 and extend thereabove having major portion 80 of keyhole port 44 disposed adjacent an outer peripheral rim wall 66. Intermediate shelf units 40 are formed with peripheral rim wall 66 extending completely around angled side faces 46, rear face 43, boss 149, front face 41 and recessed face 42. A separate wall at ends 144 of cartridge receiving slots 143 creates a cavity 67 bounded internally by ends 144 and peripheral rim wall 66. Cavity 67 is provided in intermediate shelf unit 40 primarily to provide for material savings in the manufacture thereof thus also resulting in a savings of weight and cost. Access holes 76 are formed through top 48, access holes 76 having living hinge portions 60 disposed therein as will be hereinafter described.

Referring now to FIGS. 6, 7, 8 and 9, each keyhole port 44 has a major portion 80 thereof which is preferably substantially circular although major portion 80 may also be triangular, elliptical or polygonal. Major portion 80 of each keyhole port 44 is slightly larger than upright member 50 for slidably engaging multiple upright members 50 and in the preferred embodiment is an arc of a circle of approximately 280 degrees having a diameter from about two percent to approximately ten percent larger than the diameter of the preferred cylindrical upright members 50. Thus, each intermediate shelf unit 40 has means for releasably retaining, designated by the numeral 75, upright member 50 passed therethrough, wherein each intermediate shelf unit 40 may freely be moved therealong. As the size of each keyhole port 44 is close to the size of the uptight member 50 passed therethrough, the intermediate shelf unit 40 could just cock against the rods or upright members 50 at an inclined angle and rest there as in one prior art device though little weight could be placed thereupon however, in the preferred embodiment shown in these figures, a means for locking 95 is associated with each keyhole port 44 for locking against upright members 50. In this preferred embodiment, major portion 80 of keyhole port 44 is disposed outwardly from the central portion having cartridge receiving slots 143 therein and therefore adjacent outer peripheral surface 81 of intermediate shelf unit 40. A wedge could be driven into each key portion 82 of keyhole port 44 thereby retaining intermediate shelf unit 40 on upright member 50, but it has been found by the teachings of this invention that the means for releasably retaining 75 comprising a living hinge portion 60 disposed opposite major portion 80 is particularly suited for slidably engaging and releasably retaining intermediate shelf units 40 on upright members 50. In addition, means for locking 95 comprises a latch 65 disposed on the exposed terminal end 70 of a finger 63 of living hinge portion 60 cooperating with locking surface 83 of keyhole port 44 for lockably engaging latch 65 with locking surface 83 providing a secure locking of intermediate shelf units 40 upon upright members 50. Living hinge portion 60 is integral with intermediate shelf unit 40 and is rotated into position across access hole 76 and into key portion 82 when intermediate shelf unit 40 is desired to be engaged with upright member 50.

Figure 8:
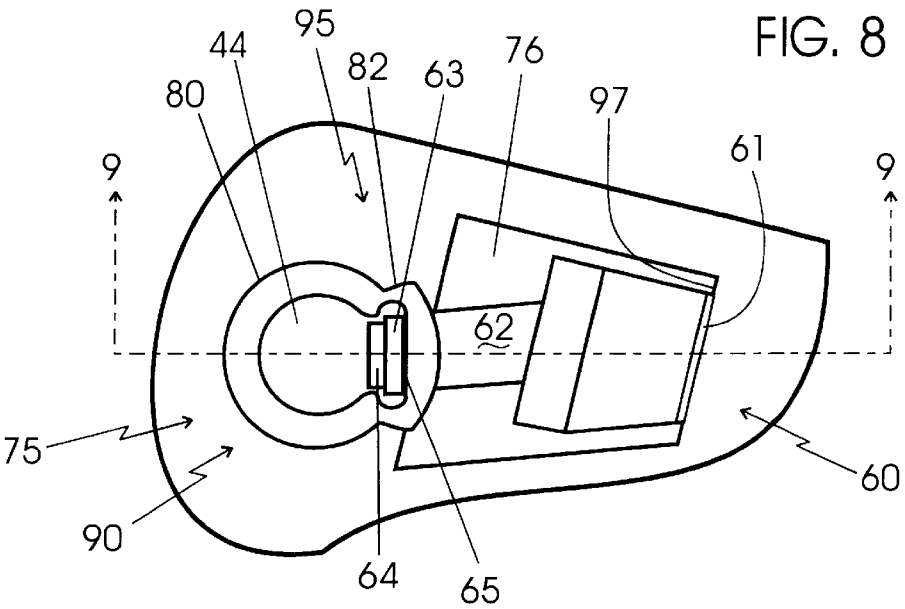
FIG. 8 is a greatly enlarged partial section view of the means for retaining associated with the intermediate shelf units of FIG. 6.
Figure 9:
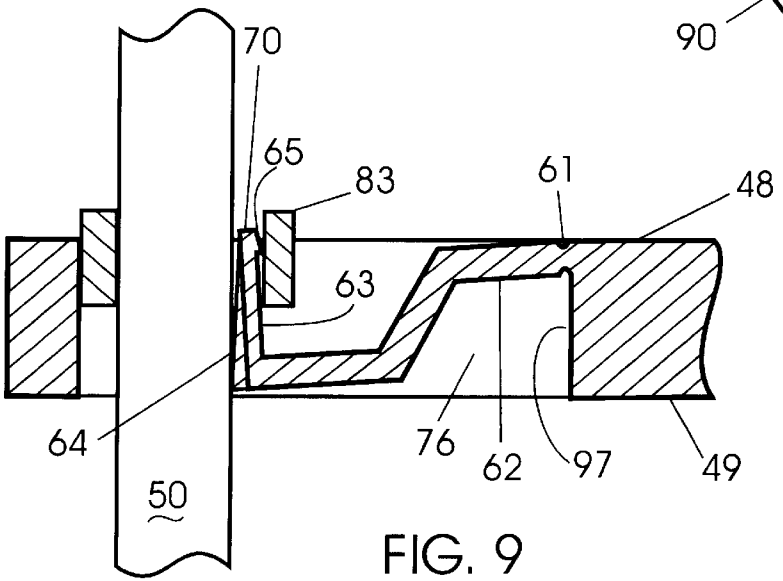
FIG. 9 is a section view taken along line 9—9 of FIG. 8.

The operation of means for releasably retaining 75 may best be observed in the enlarged broken away view of FIG. 8 and the section view in FIG. 9, means for releasably retaining 75, comprising keyhole port 44, means for engaging 90, means for locking 95 and living hinge portion 60. Living hinge portion 60 comprises living hinge 61, hand 62, finger 63, means for engaging 90 comprises ramp 64 of finger 63 and major portion 80 of keyhole port 44 while means for locking 95 comprises latch 65 on terminal end 70 of finger 63 and locking surface 83 of key portion 82. Living hinge 61 is a reduced thickness of hand 62 adjacent and contiguous with one edge 97 of access hole 76. Living hinge 61 is disposed opposite major portion 80 and has a means for engaging 90 disposed on a finger 63 of a hand portion 62 thereof. Living hinge 61 may be disposed at top 48, bottom 49 or any location along the height of one edge 97. Though the living hinge portions 60 in access holes 76 disposed inwardly from front face 41 and angled side faces 46 are mirror images and though they are each constructed differently from living binge portion 60 in access hole 76 in boss 149, the operation of all these living hinge portions 60 is substantially the same. For instance, in keyhole ports 44 disposed inwardly from front face 41 and angled side faces 46, living hinge portion 60 extends from one edge 97 at top 48 of intermediate shelf unit 40, and when in engaged with upright member 50, hand 62 extends downwardly into access hole 76 with finger 63 projecting upwardly therefrom and lying parallel to and in engagement with upright member 50. As is apparent from FIG. 6, in keyhole port 44 disposed in boss 149, living hinge portion 60 extends from one edge 97 at bottom 49 of a rear rib 47 of intermediate shelf unit 40, and when in engaged with upright member 50, hand 62 lies substantially parallel with bottom 49 with finger 63 extending perpendicular to hand 62 and parallel to and in engagement with upright member 50. It is apparent to those skilled in the art that the location of living hinge portion 60 is selected for slidable engagement of ramp 64 with upright member 50 as finger 63 is placed into key portion 82. Still referring to FIGS. 6, 8 and 9, ramp 64 of means for engaging 90 first contacts upright member 50 below key portion 82 and as finger 63 with ramp 64 thereon is moved upwardly along upright member 50, ramp 64 is adapted to force upright member 50 against major portion 80 whereby means for engaging 90 and major portion 80 frictionally engage upright member 50 and thereby releasably secure intermediate shelf unit 40 to upright member 50. As terminal end 70 of finger 63 moves beyond locking surface 83 of key portion 82, latch 65 engages with locking surface 83 thus means for locking 95 locks living binge portion 60 to keyhole port 44 with ramp 64 firmly engaging upright member 50 frictionally against major portion 80.

When the user desires to move one of intermediate shelf units 40, hand 62 of each living hinge portion 60 is accessed through access hole 76 and depressed slightly which disengages means for locking 95 from the locking surface 83 of key portion 82. Once means for locking 95 is disengaged, hand 62 is depressed further and ramp 64 on terminal end 70 of finger 63 begins sliding along upright member 50 until it becomes totally disengaged therefrom and thus living hinge portion 60 swings freely away from upright member 50. Intermediate shelf unit 40 may then be freely moved along upright members 50 to the desired location and means for releasably retaining 75 again utilized to retain intermediate shelf unit 40 to upright members 50 as hereinbefore described. When re-engaging intermediate shelf units 40 with upright members 50, each living hinge portion 60 is moved toward upright members 50 with finger 63 sliding along upright member 50 through keyhole portion 82 until ramp 64 of fingers 63 are in engagement with upright members 50. Further movement of fingers 63 along upright members 50 results in firm engagement of ramp 64 against upright members 50 and, eventually, latch 65 engages locking surface 83. It is readily apparent from the description of the movement of intermediate shelf units 40 that any location along the length of upright members 50 may be selected for placement of intermediate shelf units 40 thus not having to rely upon fixed locations as is required for prior art clamping and retaining devices.

Referring now to FIG. 1, a modular media storage unit 10 is assembled by placing lower base 20 upon a rigid substrate with one end 54 of upright members 50 placed in top receiving sockets 125. Upright members 50 may be then tapped firmly upon opposite end 55 until upright members 50 become firmly seated at resting surface 124 in receiving sockets 125. Any or all of intermediate shelf units 40 with means for releasably retaining 75 fully disengaged may then be placed on upright members 50 with upright members 50 passing freely through major portion 80 of keyhole ports 44. Finally, upper base 30 is placed upon the opposite ends 55 of each of upright members 50 with opposite ends 55 placed in bottom receiving sockets 136. Each mating boss 34 on top 38 is then tapped firmly, seating opposite ends 55 of upright members 50 to stop 133 in receiving sockets 136.

Multiple modular media storage units 10 may be joined together horizontally to form a partial or full circle and/or one modular media storage unit 10 may be placed upon any modular media storage unit 10 to extend modular media storage vertically to create media storage or display assembly 150. When desired to join already assembled modular media storage units 10 horizontally, dovetail 127 on lower base 20 of a first modular media storage unit 10 is engaged with dovetail groove 128 on lower base 20 of an adjacent modular media storage unit 10 while dovetail 137 on upper base 30 of the first modular media storage unit 10 is engaged with dovetail groove 134 of upper base 30 of the adjacent modular media storage unit. As dovetails 127, 137 are adapted to finely fit within dovetail grooves 128, 134, the first modular media storage unit 10 is firmly engaged with the adjacent modular media storage unit 10. It is readily apparent here, that additional modular media storage units 10 may be likewise assembled to form a media storage or display assembly 150 comprising a full circle of modular media storage units 10, wherein a total often modular media storage units 10 are required. It is generally easier though, to assemble dovetail 127 of each lower base 20 with dovetail groove 128 of each successive lower base 20 to form the desired number of joined modular media storage units 10 and thereafter place upright members 50 in receiving sockets 125 in all the lower bases 20 with intermediate shelf units 40 being slidably engaged upon upright members 50 before attempting to assemble upper bases 30 onto each modular media storage unit 10. When assembled in this manner, upper base 30 may then be placed upon upright members 50 of one modular media storage unit 10 with dovetail 137 engaged with dovetail groove 134 of the previous modular media storage unit 10 and firmly seated upon upright members 50 before proceeding to each successive modular media storage unit 10. When stacking one modular media storage unit 10 upon another, it is usually easiest to fully assemble the desired modular media storage units 10 separately and then firmly seat an upper modular media storage unit 10 to a lower modular media storage unit 10 by placing bosses 34 of upper base 30 of lower modular media storage unit 10 into bottom receiving sockets 126 of lower base 20 of the upper modular media storage unit 10. The weight of the upper modular media storage unit 10 will be sufficient to keep the upper modular media storage unit 10 firmly engaged with the lower modular media storage unit 10. When one modular media storage unit 10 is assembled on top of a lower modular media storage unit 10, floor surface 122 of lower base 20 of the upper modular media storage unit 10 is contiguous with top 38 of upper base 30 of the lower modular media storage unit 10. The user may extend modular media storage units vertically and in a circle to achieve a tower having thirty or more modular media storage units 10 in a media storage or display assembly 150. For instance, a media storage or display assembly 150 having each mating boss 34 of each upper base 30 of a first ten modular media storage units 10 received in lower receiving sockets 126 of an additional ten modular media storage units 10 provides for a circular tower media storage or display assembly of twenty modular media storage units 10. Likewise, wherein each said mating boss 34 of each upper base 30 of the additional ten modular media storage units 10 is received in lower receiving sockets 126 of a third set often modular media storage units 10 thereby provides a circular tower media storage or display assembly 150 of thirty modular media storage units 10 and wherein each upper base 30, each lower base 20 and each intermediate shelf unit 40 has at least one, and preferably multiple, cartridge receiving slot 143, 123, 72 respectively formed therein for receiving media cartridges therein.

Each of lower base 20, upper base 30 and intermediate shelf units 40 are preferably injection molded from a thermoplastic material such as polyamide, polyethylene, polypropylene, polystrene, polyvinylchloride or combinations thereof, any of which may contain colorants, fillers and/or reinforcing fibrous material. The molding operation may be by compression molding, transfer molding or the preferred method, injection molding. A single mold cavity is utilized to mold each of the three parts by utilizing replaceable inserts. For instance, lower base 20 may be molded in a cavity having the general outline shape shown in FIG. 2, the cavity having a depth substantially equal to the thickness of lower base 20 with the parting line for the mold system being at top 28. Ejector pins having the same shape and depth as bottom receiving sockets 126 are provided in the locations desired for receiving sockets 126. The upper half of the mold cavity carries a mirror image of cartridge receiving slots 123 with spaces therebetween to provide for ribs 27, this mirror image depending from the parting line by the height of cartridge stop 94, that is about one eighth inch. The mirror image of cartridge receiving slots 123 has grooves cut in the lowermost surface thereof for molding of wall 120. Top receiving sockets 125 and boss 71 are provided by an insert placed in the upper mold half, pins of the same shape and depth as top receiving sockets 125 depend from a recess for boss 71 at the locations desired for top receiving sockets 125. Ejector pins for bottom sockets 126, pins for top receiving sockets 125, recess for boss 71 and each of dovetail 127 and dovetail groove 128 are provided as replaceable inserts which can be removed from their respective locations and utilized elsewhere or removed from the mold system entirely to provide for a different configuration of molded part. For instance, to mold upper base 30, the pins used to mold top receiving sockets 125 are removed from sockets in the upper half of the mold and are replaced with a solid pin flush with the base of the recess for boss 71. Thus, a solid surface 98 is molded for bosses 34 on upper base 30. In the same manner, the ejector pins are replaced with ejector pins of a smaller diameter to provide for molding of bottom receiving sockets 136 in upper base 30. There is no need to remove the insert for dovetail 127 or dovetail groove 128 as dovetail 137 and dovetail groove 134 are identical thereto and in the same location on upper base 30. When upper base 30 or lower base 20 is formed, a projection such as dovetail 137, 127 is formed integrally with one side edge 36 of upper base 30 or with one side edge 26 of lower base 20, respectively and a mating slot 134, 128 is formed into another side edge 36 of upper base 30 or into another side edge 26 of lower base 20, respectively.

In order to mold intermediate shelf unit 40, a peripheral insert is placed completely around the inside periphery of the lower half of the mold, keying this peripheral insert to the inserts for the dovetail 137 and dovetail groove 134, these inserts having been removed therefrom. Additional inserts are added to the upper half of the mold to provide for access holes 76 at the locations desired therefor. The insert for upper sockets 125 and bosses 71 is replaced with an insert having the mirror image of major portion 80 and key portion 82 with pins extending centrally therefrom to provide for keyhole ports 44. Finally, a new insert is placed into the bottom of the lower half of the mold immediately below the locations for access holes 76, this new insert adapted to provide for molding of living hinge portions 60, the insert for the living hinge portion 60 in boss 149 being different from the insert for the living hinge portions adjacent front face 41. As is readily apparent, each of the three parts may be molded in successive production runs by merely replacing the appropriate inserts for each run. Mirror image of cartridge receiving slots 123 with spaces therebetween to provide for ribs 27 remains integral with the upper half of the mold cavity as these slots and ribs are provided in each of upper base 30, lower base 20 and intermediate shelf units 40.

Upright members 50 may be formed from metal tubing in a continuous extrusion and cut to length utilizing means well known in the art but are usually formed from an elongated, thin, narrow flat metallic strip having "U" shaped grooves formed along each edge of the narrow strip, the narrow strip then being rolled from one edge toward the other edge to form a tube. The "U" shaped portions are then interengaged to complete the formation of the upright members 50. Upright members 50 are generally formed of steel sheet metal but may be formed of any suitable material such as aluminum, steel, brass, thermoplastic or combinations of the above and may be extruded from these materials and coated with another material as desired. Alternately, upright members 50 could be solid and made from steel, aluminum, wood or plastic rods or dowels.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the preferred embodiment of the invention and should not be construed to be the only variants thereof nor limited thereto.

What is claimed is:

1. A media storage or display unit adapted to stand erect and receive a plurality of media storage cartridges thereon, said media storage unit having a plurality of upright members, a plurality of movable intermediate shelf units, a lower base and an upper base, wherein each said upright member is releasably secured in a receiving socket receiving socket in said lower base and additionally releasably secured in a receiving socket in said upper base, said movable intermediate shelf units being disposed intermediate said upper base and said lower base upon said plurality of upright members, each said movable intermedate shelf unit having a plurality of keyhole shaped ports disposed therethrough, each said port adapted for receiving one of said upright members therethrough and each said intermediate shelf unit having means for slidably engaging and for holding the intermediate shelf in a selected position on said plurality of upright members wherein said means for slidably engaging is formed integral with said shelf unit, each said keyhole port having a major portion thereof which is substantially circular and wherein said keyhole port has a living hinge portion disposed opposite said major portion, said living hinge portion having said means for slidably engaging said upright member.

* * * * *